US007213294B2

(12) United States Patent
Karroll

(10) Patent No.: US 7,213,294 B2
(45) Date of Patent: May 8, 2007

(54) PAINT APPLICATOR

(76) Inventor: David Karroll, P.O. Box 997, Rimbey, Alberta (CA) T0C 2J0

( * ) Notice: Subject to any disclaimer, the term of this patent is extended or adjusted under 35 U.S.C. 154(b) by 0 days.

(21) Appl. No.: 10/904,733

(22) Filed: Nov. 24, 2004

(65) Prior Publication Data

US 2006/0107483 A1 May 25, 2006

(51) Int. Cl.
*B05C 17/02* (2006.01)

(52) U.S. Cl. ..... 15/230.11; 15/172; 15/144.1; 492/13; 492/19; 403/96; 403/97

(58) Field of Classification Search ..... 15/230.11, 15/230, 230.4, 144.1, 144.2, 172; 492/13, 492/17, 19; 403/96, 97
See application file for complete search history.

(56) References Cited

U.S. PATENT DOCUMENTS 186,399 A * 1/1877 Israel ..... 403/66
727,035 A * 5/1903 Van Loan ..... 403/66
1,140,020 A * 5/1915 Bradley ..... 172/372
1,651,251 A * 11/1927 Calkins ..... 15/172
1,994,677 A * 3/1935 Wildhaber ..... 403/58
2,432,098 A * 12/1947 Horn ..... 15/144.1
2,749,599 A 6/1956 Kreger ..... 29/116
2,799,884 A 7/1957 Bedford ..... 15/230
3,273,192 A 9/1966 Mazzella ..... 15/230.11
3,408,676 A 11/1968 Cayo ..... 15/230.11
3,906,581 A 9/1975 Marino et al. ..... 15/230.11
4,196,491 A 4/1980 Baril ..... 15/230.11
4,528,714 A 7/1985 Beck
5,207,755 A 5/1993 Ampian ..... 15/230.11
5,769,769 A 6/1998 Torntore ..... 492/13
5,915,807 A * 6/1999 Ilagan ..... 33/471
6,128,802 A 10/2000 Lye ..... 15/230.11
6,378,158 B1 4/2002 Bukovitz ..... 15/230.11
6,668,605 B2 * 12/2003 Hengelhaupt et al. ..... 70/236

FOREIGN PATENT DOCUMENTS

CA 2428045 11/2003

* cited by examiner

*Primary Examiner*—Gary K. Graham
(74) *Attorney, Agent, or Firm*—Bennett Jones LLP

(57) ABSTRACT

A paint applicator includes a paint roller having a pivotally adjustable handle.

3 Claims, 3 Drawing Sheets

PAINT APPLICATOR

BACKGROUND OF INVENTION

The present invention relates to an adjustable paint applicator.

Residential painting may involve either new construction or repaints of existing homes. New construction painting is typically provided by professionals who are skilled in the art of painting and are continually looking for tools, products and application methods to provide a high quality paint job with a minimum of effort. Occasionally, homeowners will attempt to paint their own new homes.

Typically, repaint jobs are attempted by the owner, although many people will employ professionals for these jobs. Many homeowners who have attempted to do their own painting, come to appreciate the skill, tools and time required to do the work properly.

Paint rollers are well known which allow relatively quick coverage of large surface areas. To reach ceilings and higher areas, extension in the form of extendible handles are also well-known. In some instances, those handles may be pivotably adjustable, as shown in U.S. Pat. No. 3,273,192 and U.S. Pat. No. 5,207,755.

Therefore, there is a need in the art for an improved paint applicator system which mitigates the difficulties of the prior art.

SUMMARY OF INVENTION

The present invention is directed to a paint applicator comprising a shaft having a distal end having a paint applying surface and a proximal end comprising a handle, said shaft comprising a pivoting joint disposed between the distal end and proximal end, said pivoting joint comprising:

(a) a first disc defining a plurality of openings along a periphery, (b) a second disc defining a single opening, wherein the first and second discs are rotatably attached wherein the second disc opening may align with any one of the first disc openings by rotating the second disc in relation to the first disc.

(c) a locking pin mounted to a planar resilient tensile strip which is mounted to the first or second disc and which extends beyond the periphery of the first and second discs, wherein said pin passes through the second disc opening and into one of the first disc openings.

BRIEF DESCRIPTION OF DRAWINGS

The invention will now be described by way of an exemplary embodiment with reference to the accompanying simplified, diagrammatic, not-to-scale drawings. In the drawings.

DETAILED DESCRIPTION

Figure 1:
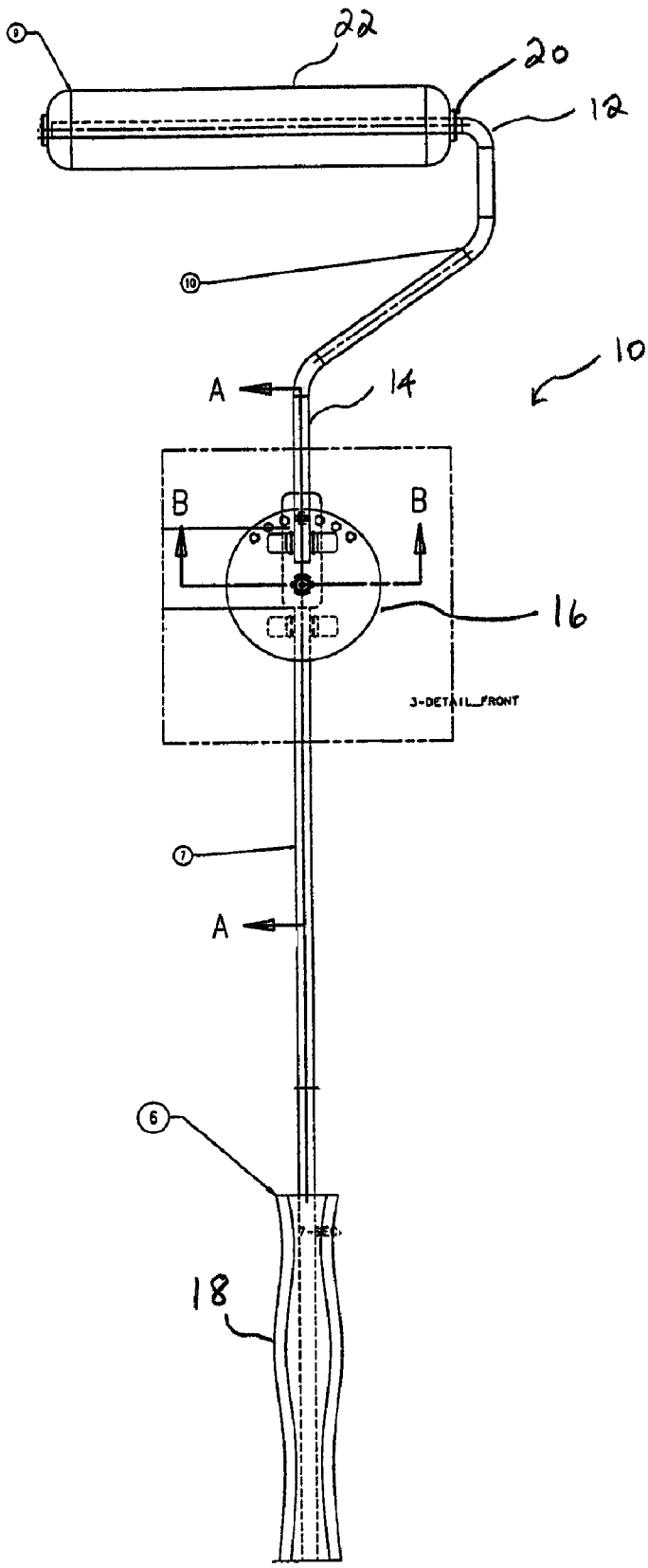
FIG. 1 is an illustration of an embodiment of the present invention.

The present invention provides for a novel paint applicator. When describing the present invention, all terms not defined herein have their common art-recognized meanings.

The apparatus depicted in the Figures comprises a paint applicator (10) which includes a roller (12), a shaft (14) having a pivoting joint (16) and an elongated handle (18).

As shown in FIG. 1, the roller (12) includes a roller holder (20) upon which a roller sleeve (22) is slidingly affixed, as is well known in the art. The sleeve (22) bears an external textured surface which retains and applies paint, again as is well known in the art. In one embodiment, the surface is a napped surface with between about a ¼ inch to about a 1 inch nap. The small nap rollers are suitable for smooth surfaces such as drywall while the thicker naps are useful for heavily textured surfaces such as brick or concrete surfaces.

The shaft (14) and pivoting joint includes a first disc (30) and a second disc (32) which are aligned and joined at their centres such that the two discs may rotate relative to each other. The first disc is rigidly attached to a distal portion (14A) of the shaft, while the second disc is rigidly attached to a proximal portion (14B) of the shaft. The first disc defines a plurality of holes (34) along the periphery of the disc. The second disc defines a single opening (36) which may be aligned with any one of the first disc holes by rotating the second disc relative to the first disc.

Figure 2:
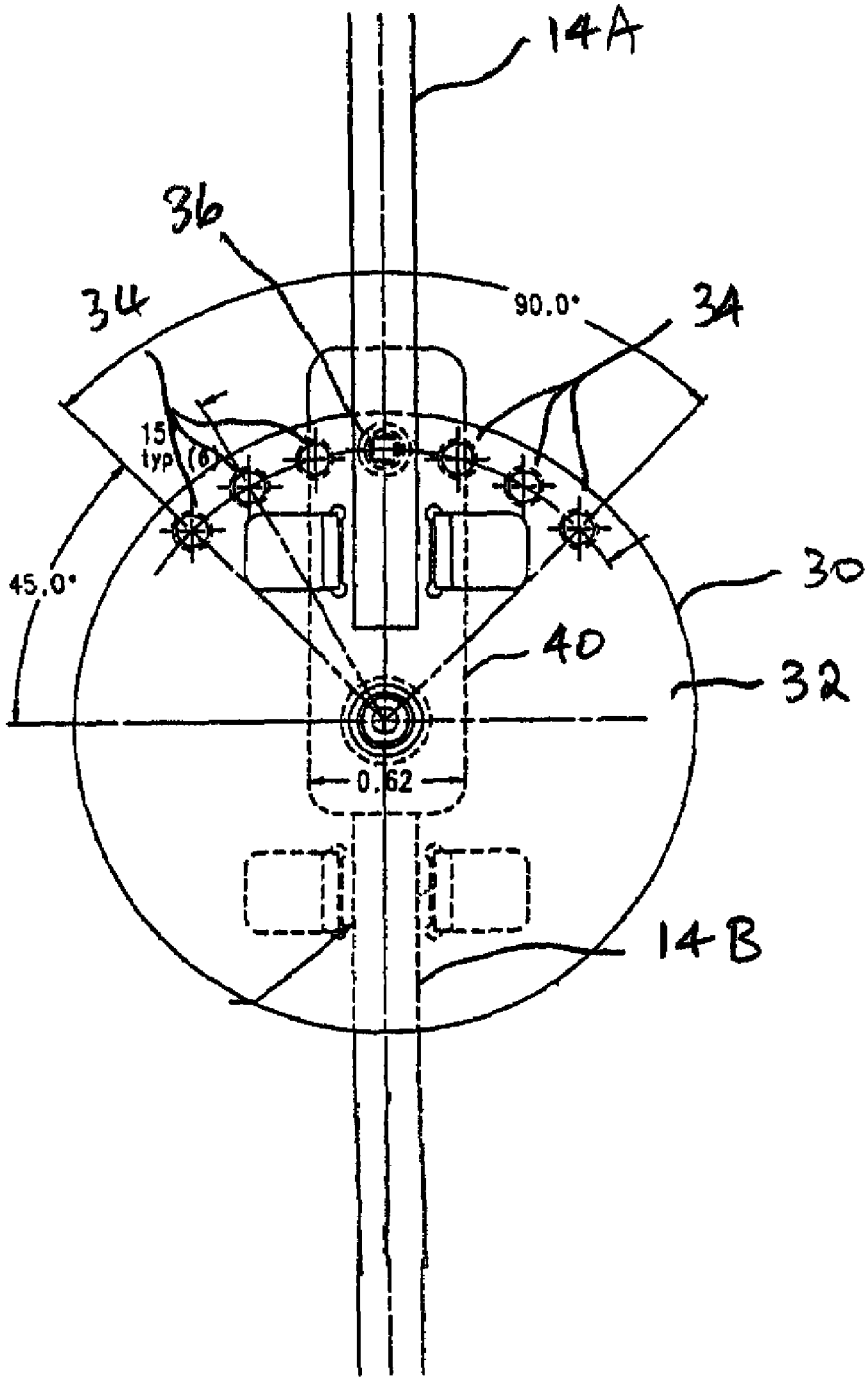
FIG. 2 is a detailed view of one embodiment of the pivoting joint.
Figure 3:
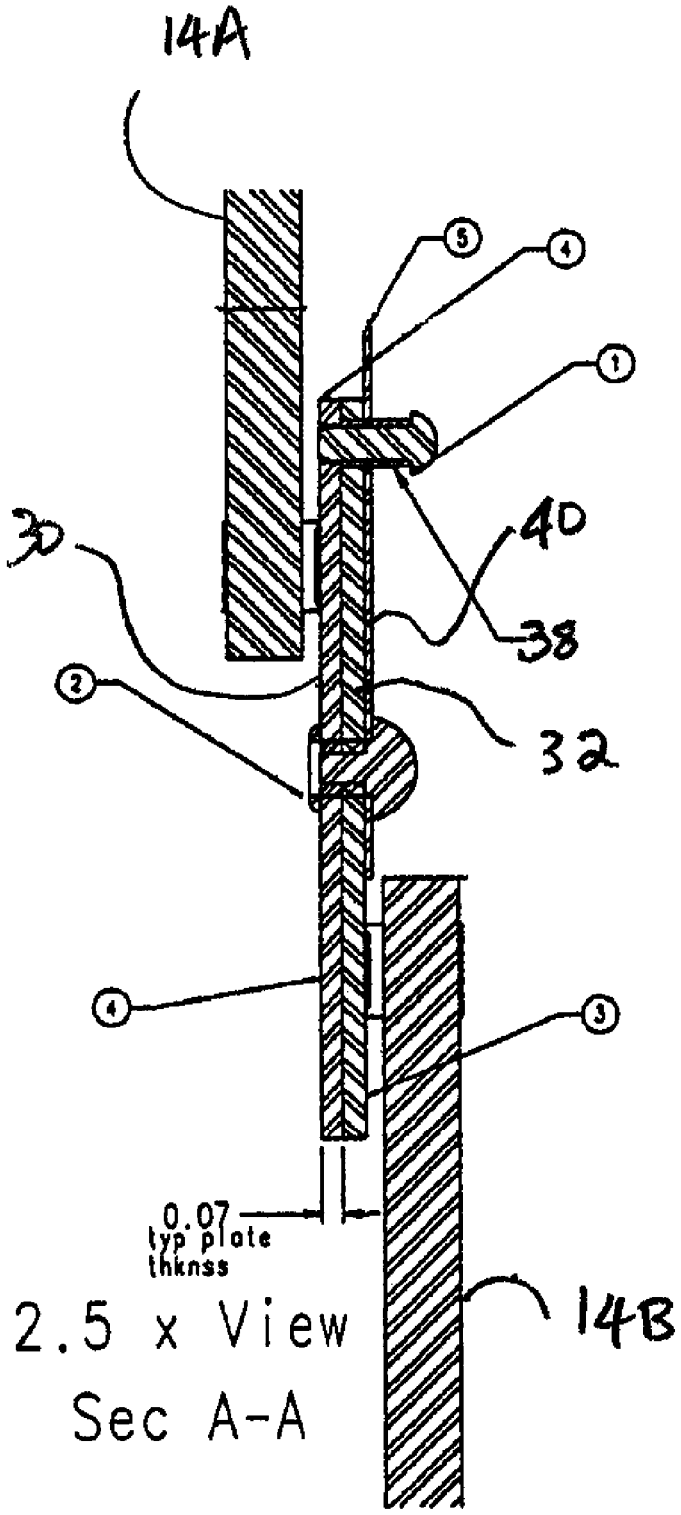
FIG. 3 is a cross-sectional view of the pivoting joint.

A locking pin (38) passes through the disk openings (34, 36) which locks the pivoting joint into a set position. Preferably, the diameter of the locking pin closely matches the size of the openings so that there is little play in the pivoting joint. The locking pin is mounted to a resilient tensile strip (40), which is preferably a thin flat piece of resilient metal mounted to the second disc. as shown in FIGS. 2 and 3. The tensile strip (40) may be deformed such that the locking pin is removed from the openings, permitting adjustment of the pivoting joint. Once the desired position is achieved and the first disc opening and the second disc opening are aligned, the tensile strip may be released to position the locking pin in the openings. Preferably, a portion of the tensile strip extends beyond the diameter of the discs, permitting easy operation of the tensile strip by a convenient thumb action. Alternatively, or additionally, the locking pin may have a raised head which permits a user to grasp the locking pin and pull the pin out of the openings. The tensile strip (40) is preferably formed from a thin strip of resilient steel.

As will be appreciated by those skilled in the art, if the first disc (30) defines 7 holes (34) along a 90° arc of the disc periphery, the pivoting joint (16) may be adjusted to any one of 7 positions. In a central position, the shaft will be straight as if monolithic. The pivoting joint (16) can then be adjusted such that the distal portion (14A) of the shaft is bent up to 45° from the proximal portion (14B) of the shaft. Additional range of motion, and fine adjustment of the pivoting joint may be achieved by providing more openings (34) along a greater arc segment.

The handle may be extendible or retractable to vary its length, as it well known in the art.

As will be apparent to those skilled in the art, various modifications, adaptations and variations of the foregoing specific disclosure can be made without departing from the scope of the invention claimed herein. The various features and elements of the described invention may be combined in a manner different from the combinations described or claimed herein, without departing from the scope of the invention.

What is claimed is:

1. A paint applicator comprising a shaft having a distal end having paint applying means and a proximal end comprising a handle, said shaft comprising a pivoting joint disposed between the distal end and proximal end, said pivoting joint comprising:

(a) a first disc defining a plurality of openings along a periphery, (b) a second disc defining a single opening, wherein the first and second discs are concentrically aligned and rotatably attached with one another wherein the second disc opening aligns with any one of the first disc openings by rotating the second disc in relation to the first disc; and (c) a locking pin mounted to a planar resilient tensile strip which is mounted to the first or second disc and which extends beyond the periphery of the first and second discs, wherein said pin passes through the second disc opening and into one of the first disc openings, and wherein said pin comprises a graspable head which is spaced from the resilient strip.

2. The paint applicator of claim 1 wherein the resilient strip comprises a metal strip.

3. The paint applicator of claim 1 wherein the paint applying means comprises a roller mandrel for accepting a cylindrical roller.

* * * * *